US005826940A

United States Patent [19]

Hodgdon

[11] Patent Number: 5,826,940

[45] Date of Patent: Oct. 27, 1998

[54] REACTIVE MULTI-POSITION CHAIR

[76] Inventor: Dewey Hodgdon, 48 Forster Rd., Manchester, Mass. 01944

[21] Appl. No.: 654,418

[22] Filed: May 28, 1996

Related U.S. Application Data

[63] Continuation-in-part of Ser. No. 562,915, Nov. 27, 1995.

[51] Int. Cl.[6] ..... A47C 3/00

[52] U.S. Cl. ..... 297/303.1; 297/300.1; 297/300.2; 297/316; 297/320

[58] Field of Search ..... 297/303.1, 286, 297/290, 300.1, 300.2, 300.6, 316, 320, 321, 323, 340

[56] References Cited

U.S. PATENT DOCUMENTS 4,765,679 8/1988 Lanuzzi et al. ..... 297/316 X
4,865,384 9/1989 Desanter ..... 297/320 X
5,486,035 1/1996 Koepke et al. ..... 297/300.1 X
5,660,439 8/1997 Unwallaw ..... 297/300.2 X

FOREIGN PATENT DOCUMENTS 2125284 3/1984 United Kingdom ..... 297/340

*Primary Examiner*—Laurie K. Cranmer
*Attorney, Agent, or Firm*—Don Halgren

[57] ABSTRACT

The present apparatus comprises a multi-position chair assembly for the full back and bottom support of a user through a range of sitting postures, including a movable lower bottom support panel secured to a hub and column, by an adjustment control mechanism, and a back support panel pivotably secured to the hub by a frame struts connected to the hub and to the back support panel, the lower bottom support panel and the back panel having a linkage therebetween to permit corresponding posture supportive tilting of the back support panel depending upon the user position-induced tilting of the lower bottom support panel.

2 Claims, 4 Drawing Sheets

REACTIVE MULTI-POSITION CHAIR

This application is a continuation-in-part of Ser. No. 562,915 filed Nov. 27, 1995.

BACKGROUND OF THE INVENTION

1. Field of the Invention

This invention relates to chairs, and more particularly to articulable chair seat and back portions which accommodate a plurality of the user's positions, and is a continuation-in-part application of my co-pending U.S. application Ser. No. 08/562,915, filed Nov. 27, 1995, and which is incorporated herein by reference in its entirety.

2. Prior Art

The chair industry has changed the design of seating and support arrangements over the past few years. Modern office furniture now includes chairs having height adjustments as well as seat portions which tilt forwardly, remain stable or backwardly, as the back portions of the chairs rotate backwardly.

Such action or non-action of seat surfaces and the back support surfaces don't always provide the body contact and support an individual may need in any one of a number of positions which may range from sitting upright, to a relaxed rearward slouching position.

It is the object of the present invention, to provide a seating arrangement, which improves upon the body support over that of the prior art.

It is yet a further object of the present invention to provide a chair support and back support which mimics the angular position of the body portions while providing full support thereto.

BRIEF SUMMARY OF THE INVENTION

The present invention relates to a multi-position body mimicking seat and back support arrangement chair, all being supported on a vertical column. The vertical column has a lower end with a hub having a plurality of chair supporting feet disposed angularly therefrom.

The support column has an upper end, with a hub which is rotatedly supported thereon. The hub has a first or forward directed arm which engages a flexible resilient pad. The resilient pad has a lower surface which is attached to the forward extended arm. The resilient pad has an upper surface, which engages the lower surface of a seat support panel comprising the base support of the chair. A horizontally exposed axle is fixedly attached to the rear side of the support hub which is disposed at the top end of the support column. The horizontally disposed support arm extends substantially the full transverse width of the support base of the chair. A pair of arcuately shaped support struts are locatedly journalled, one at each end of the horizontal support arm. Each arcuate support strut, has a distal upper end, which is fixedly attached to a rotation pin. Each rotation pin is disposed at the lower most side edge of the formed back support panel of the chair assembly. A rigid back support spine extends vertically adjacent the side edges the back support panel. The vertically disposed spine portions are fixedly attached to the support pins at the distal end of the arcuate frame members. The support spine, have a lower most portion which curves inwardly and under the seat support panel. The distal end of the lower spinal arm, have transversely extending horizontally exposed pins, which slidingly mate within an arcuate slot at the rearward lower most portion of the seat support panel.

A flexible, somewhat semi-circularly shaped arm, is disposed between a midpoint on each side of the back support panel, and a mid-point on each respective side of the seat support panel. Each arm rest, is flexible, so as to accommodate articulation between the rear back support panel and the seat support panel.

The posture and thus the position of a user of this chair assembly is determined basically by the vertical location of the user's center of gravity on the lower support panel. If the user aligns his center of gravity rearwardly of the support column, the lower support panel will have a larger moment arm arranged thereon, with respect to the flexible resilient pad holding the lower support panel near its front edge. The rearwardly directed center of gravity, thus causes the rearward edge of the lower support panel to yield somewhat downwardly. This causes the pin extending off of the lower spinal support member, to slide to the rearward edge of the slots disposed off of each side of the lower support panel. This puts a bending moment onto the lower spine portion and causes rotation about the support pin, on which the back support panel is articualably mounted. Rotation of the lower most spinal member in one direction, in this case downwardly and rearwardly, causes the back support panel to be moved to a more forward position, thus effecting a more upright position against the back of a user sitting with a more erect posture.

With a user seated with his center of gravity aligned approximately with the alignment of the support column or just slightly forward of that, the rearward edge of the lower support panel is permitted to rise to a neutral or intermediate position, the force moment not being as great thereon so as to affect such a downward bending thereat. In this neutral orientation, each pin sliding within its respective slot at the lower rearward edge of the lower support panel, is in a neutral or intermediate position within the slot, and hence the support spine on the back support panel is also correspondngly in a neutral or somewhat vertical orientation.

When a user is in a more relaxed orientation, and is somewhat slouching, his center of gravity is disposed more forwardly on the lower support panel, almost directly over the flexibly resilient pad. The user is thus presenting no moment force around the support location of the flexible resilient pad on the bottom of the lower support panel. The user in that location typically would lean backwardly, the rearward edge of the lower support panel thus being permitted to rise upwardly, the pin on the lower spinal member sliding to the forward end of the slots on the lower side of the lower support panel. As the pins slide to the forward end of their slots, the lower support spine pivots upwardly, and the back support panel attached to the upwardly directed end of the spine, is directed to an incline for a more relaxed position rearwardly.

Thus in a more relaxed position, the user finds his body supported beneath his knees at the forward edge of the lower support panel, his lower back supported between the upwardly extending rearward edge of the lower support panel and the lower edge of the rearwardly inclining back support panel, thus providing a more uniform pattern of entire body support when the user of such a chair assembly goes from one position to another position within that chair assembly.

The invention thus comprises a multi-position chair assembly permitting the support and comfort of a user thereof, in a plurality of sitting positions, including a lower chair support panel attached to an adjustable tilt support mechanism, which adjustable tilt support mechanism is carried by a vertically maintained hub, and a frame attached to the hub for supporting a chair back support panel, the back support panel being pivotably attached to the frame to permit tilting of the back support panel relative to the center of gravity of a user of the chair assembly with respect to the adjustable tilt support mechanism under the lower support panel. The lower support panel and the back support panel are connected by a slidable linkage which effects pivoting of the back support panel about a horizontal axis when the lower support panel is tilted about the adjustable tilt support mechanism. The back support panel has a lowermost member having a carrier pin extending transversely from each corner thereof, and the lower support panel has a frame with a slot therein adjacent its rearward edge, the carrier pin being in a cammed slidable linkage relationship with the slot to effect the pivotable relationship between the lower panel and the back support panel. An arm rest is disposed on each side of the chair assembly, the arm rest being pivotably connected at an upper end thereof, to the back support panel, and also being pivotably connected at a lower end thereof, to the lower support panel, to permit articulation between the back and lower support panels and the arm rests. The frame supporting the back support panel comprises a pair of arcuate struts having a lower end which are fixedly attached to a horizontal axis attached to the hub, each of said struts having an upper distalmost end with a pivot pin thereat, each pivot pin being mated with a bearing location on the back support panel.

The invention in a further embodiment also includes a somewhat linear back support panel, which may be made of a molded polymer or molded multiple layers of wood product. The back support panel in this embodiment differs from the aforementioned embodiment, in that its lowermost half has only a slight molded curvature thereto, the lowermost portion having a mounting bracket thereon.

The mounting bracket, which may be made of steel or heavy gauge polymer, is of somewhat "V" in transverse section. The "V" frame mounting bracket is comprised of an upper portion and a lower portion. The upper portion of the "V" shaped frame member has a pin extrusion thereon. The pin extrusion may be attached to the upper portion of the "V" shaped frame by adhesive, bolts, or the like.

The pin extrusion, preferably made of a polymer or a metal such as steel, has a generally rectangular base which is attached to the upper portion of the "V" shaped frame. A support bar extends generally perpendicularly upwardly from the planar base of the pin extrusion.

A rod like pin member is attached along the support bar in longitudinal alignment therewith. The pin member and the support bar are preferably of integral extrusion. The pin member extends longitudinally beyond the ends of the support bar and the ends of the "V" shaped frame member.

Each end of the pin member is arranged to extend into the arcuate slot at the rearward lowermost portion of the seat support panel, in a manner similar to the transversely extending horizontally disposed pins of the aforementioned embodiment.

The lower portion of the back support panel is permitted a forward and rearward bending, depending upon the posture of the user sitting in the seat portion of the chair assembly and the location of the support pin within the arcuate slot at the rearward lower portion of the seat panel. This back support panel is permitted to pivot about the upper distal ends of the frame members to which it is attached. Such forward and rearward pivoting of the lower portion of the back support panel accommodates a corresponding rearward and forward pivoting of the upper portion of the back support panel of this embodiment. The support pin slides to the rear of the arcuate slot, as the seat support panel pivots downwardly, and the lowermost portion of the back support panel pivots rearwardly as the upper portion of the back support panel pivots toward the forward side of the chair assembly. As the user of a chair assembly places his/her center of gravity towards a more forward position on the lower support panel (as may be done in a "slouching" position), the rearward portion of the support panel is permitted to pivot upwardly, thus effecting the support pin to move in a direction towards the forward side of the arcuate slot, and thus the lower portion of the back support panel is pivoted forwardly about the pivot point on its support frame, the upper portion of the back support panel pivoting correspondingly rearwardly.

Thus it is shown in both the molded and generally linear embodiments of the back support panel, that a pivoting motion of the back support panel is effected by the posture and positioning of a user on the lower seat support portion. The registration and intermating of cooperative cams and cam slot members thus permitting articulation of each particular support member to reinforce the posture or lack thereof, of the user of the chair assembly.

The invention also includes a multi-position chair assembly for the full back and bottom support of a user through a range of sitting postures, comprising a movable lower bottom support panel secured to a hub and column by an adjustment control mechanism or other suspension system, and a back support panel pivotably secured to the hub by a frame connected to the hub and to the back support panel, the lower bottom support panel and the back panel having a linkage therebetween to permit tilting of the back support panel depending upon the tilting of the lower bottom support panel. The back support panel having a pair of cam members on a lower end thereof, and the lower bottom support panel having a pair of cam slots adjacent a lower back edge thereof, the cams and cam slots having a slidable relation to effect resultant pivotal movement in said back support panel when the bottom support panel is tilted about the adjustment control mechanism.

The frame comprises a pair of struts attached to the hub, the struts having distal upper ends which are pivotally connected to the back support panel, to permit such tilting thereof.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

The present invention relates to a multi-position body mimicking seat and back support arrangement chair 70, all being supported on a vertical column 14. The vertical column 14 has a lower end, not shown in this application, with a hub having a plurality of chair supporting feet disposed angularly therefrom, as is shown in my co-pending U.S. patent application Ser. No. 08/562,915 filed on Nov. 27, 1995, and is incorporated herein by reference in its entirety.

Figure 1:
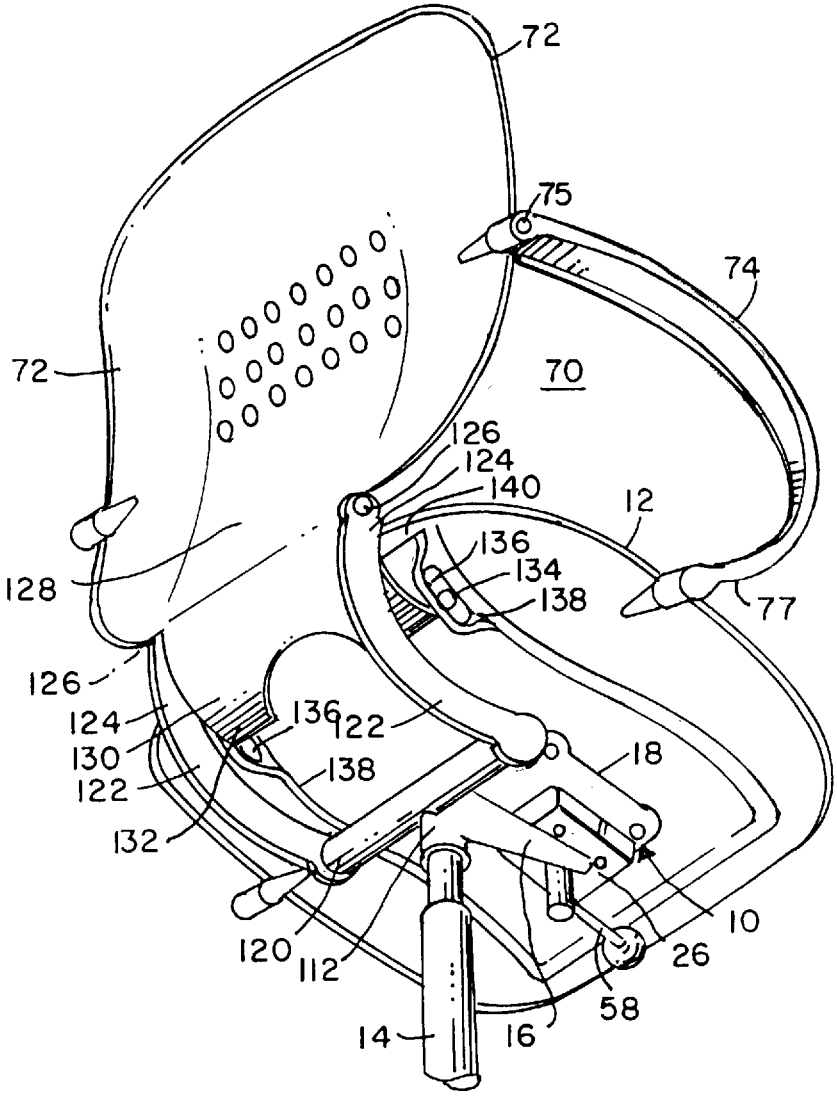
FIG. 1 is a perspective view of a chair assembly, showing a lower quadrant thereof, displaying the principles of construction of the present invention.
Figure 3:
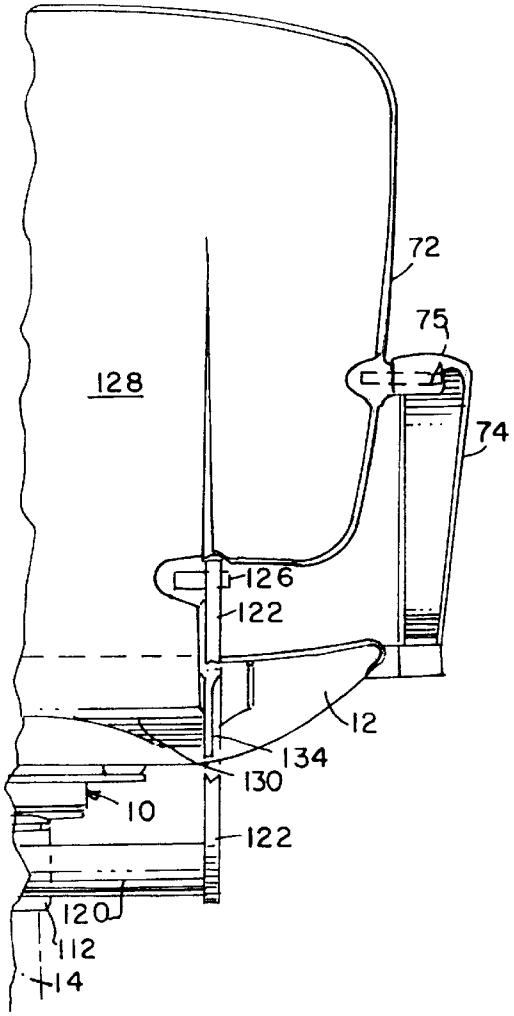
FIG. 3 is a rear elevational view of one half of the chair assembly of the present invention.
Figure 2:
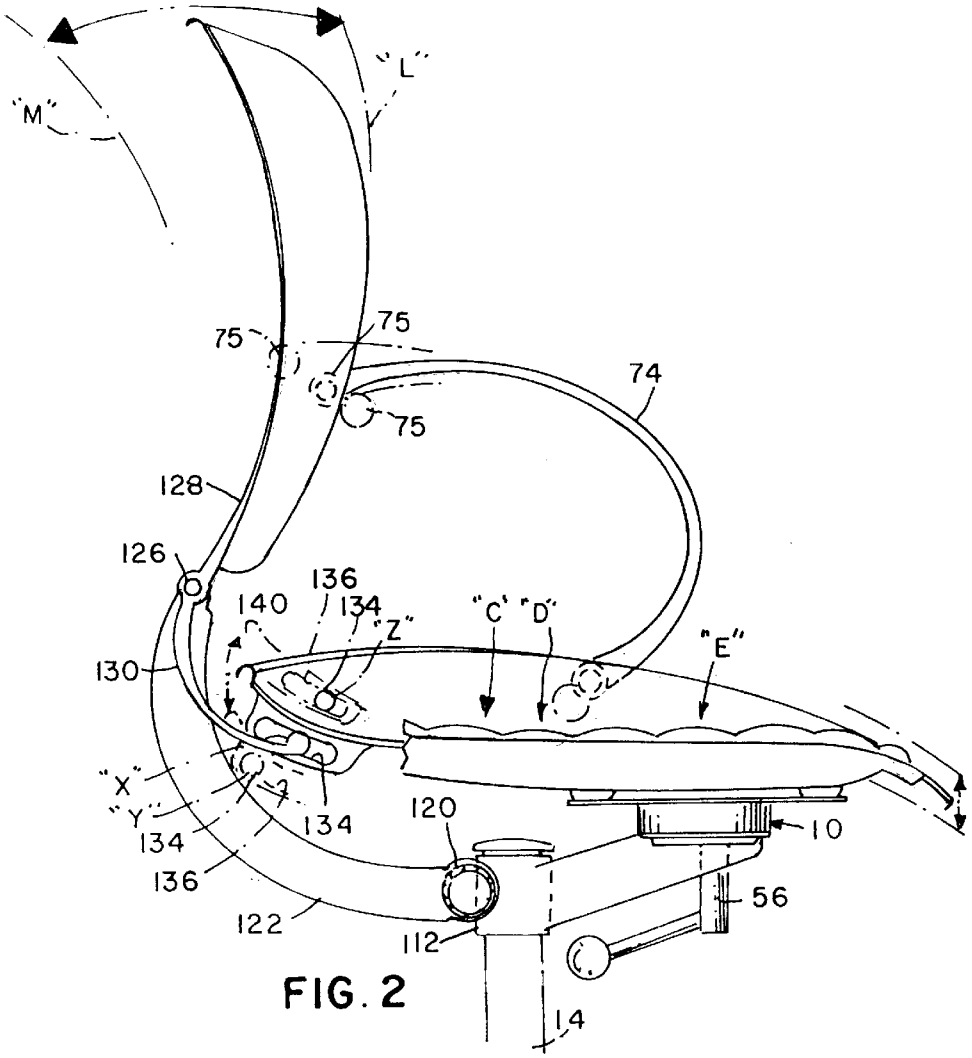
FIG. 2 is a side elevational view partly in section of a portion of the chair assembly of the present invention.

The support column 14 has an upper end, with a hub 112 which is rotatedly supported thereon. The hub 112 has a first or forwardly directed arm 16 which engages a support such as a tilt control mechanism 10, as shown and described in my aforementioned copending application. A horizontally disposed axle 120 is fixedly attached to the rear side of the support hub 112 which is disposed at the top end of the support column 14. The horizontally disposed support axle 120 extends substantially the full transverse width of the support base of the chair. A pair of arcuately shaped support struts 122 are rigidly attached, one at each end of the horizontal support axle 120. Each arcuate support strut 122, has a distal upper end 124, to which a rotation pin 126 is fixedly attached. Each rotation pin 126 is disposed at the lowermost side edge of the formed back support panel 72 of the chair assembly 70, as shown in FIGS. 1 and 2. A rigid back support spine 128 extends vertically adjacent the side edges of the back support panel 72. The vertically disposed spine 128 is fixedly attached to the rotation support pins 126 at the distal end of the support struts 122. The support spine 128, has a lowermost panel 130 which extends beyond and below the rotation support pins 126, and curves inwardly and under the seat support panel 12, as shown in FIGS. 1 and 2. The lowermost panel 130 may be integral with, or attached securely to the support spine 128. The lowermost distal end of the lower panel 130 has lower corners 132, which of each may have a transversely extending horizontally disposed pin 134 thereat. Each pin 134 slidingly mates with an arcuate slot 136 disposed in a frame 138 integral with or attached adjacent a rearward lowermost end portion 140 of the seat support panel 12. Each slot 136 may have a cushion or spring-like component within each end thereof, to "soften" the stopping of the movement of its pin 134 therewithin.

A flexible, somewhat semi-circularly shaped arm rest 74, is pivotally disposed on pivot pins 75 and 77, as shown in FIGS. 1 and 2, between a midpoint on each side of the back support panel 72, and a mid-point on each respective side of the seat support panel 12. Each arm rest 74 is also flexible, so as to further accommodate articulation between the rear back support panel 72 and the seat support panel 12.

The posture and thus the position of a user of this chair assembly is determined basically by the vertical location of the user's center of gravity on the lower support panel 12. If the user aligns his center of gravity rearwardly of the support column 14, as shown by the rearwardmost inverted triangle "C" shown in FIG. 2, the lower support panel 12 will have a larger moment arm with respect to the support hub 112 holding the lower panel securement apparatus which is the tilt control mechanism 10, having a resistant pad arrangement to permit any tilting therewith as reacted in my aforementioned application, and thus the lower support panel 12 near its front edge. The rearwardly directed center of gravity, thus causes the rearward edge 140 of the lower support panel 12 to yield somewhat downwardly. This causes the pins 134 extending off of the lower corners 132, to slide to the rearward edge of the slot 136 disposed off of the lower side of the lower support panel 12, at a location designated "Y", as shown in FIG. 2. This puts a bending moment onto the lower panel 130 and causes rotation about its support pin 126, on which the back support panel 72 is articulably mounted. Rotation of the lowermost panel 130 in one direction, in this case downwardly and rearwardly, (clockwise as shown in FIG. 2), causes the back support panel 12 to be moved to a more forward position, as shown by the phantom line "L" in FIG. 2, thus effecting a more upright position against the back of a user sitting with a more erect posture.

With a user seated with his center of gravity aligned approximately with the alignment of the support column or just slightly forward of that, as shown by the inverted triangle "D" in FIG. 2, the rearward edge 140 of the lower support panel 12 is permitted to rise to a neutral or intermediate position, as indicated by the letter "X" in FIG. 2, the force moment not being as great thereon so as to affect such a downward bending about the tilt control mechanism 10. In this "neutral" orientation, the pin 134 sliding within the slot 136 at the lower rearward edge 140 of the lower support panel 12 is in a neutral or intermediate position within the slot 136, as shown in FIG. 2 and hence the support spine 128 on the back support panel 72 is also correspond ally in a neutral or somewhat vertical orientation.

When a user is a more relaxed orientation, and is somewhat slouching, his center of gravity is disposed more forwardly on the lower support panel 12, as shown by the inverted triangle "E", in FIG. 2, almost directly over the tilt control mechanism 10. The user is thus presenting no moment force around the support location of the tilt control mechanism 10 on the bottom of the lower support panel 12. The user in that location typically would lean backwardly, the rearward edge 140 of the lower support panel 12 thus being permitted to rise upwardly, the pin 134, shown in phantom at "Z" in FIG. 2, on the corners 132 of the lower spinal panel 130, sliding to the forward end of the slot 136 on the lower side of the lower support panel 12, as seen in FIG. 2. As the pin 134 slides to the forward end of the slot 136 the lower support spine pivots upwardly (counterclockwise), about the back support pins 126, and the back support panel 72 attached to the upwardly directed end of the spine 128, is directed to an incline for a more relaxed position rearwardly, as shown by the phantom outline designated "M" in FIG. 2.

Thus in a more relaxed position of the chair assembly of the present embodiment, the user finds his body supported by his buttocks at the forward edge of the lower support panel, his lower back supported between the upwardly extending rearward edge of the lower support panel and the lower edge of the rearwardly inclining back support panel, and his upper back by the upper portion of the back support panel thus providing a more uniform pattern of entire body support when the user of such a chair assembly goes from one position to another position within that chair assembly.

Figure 4:
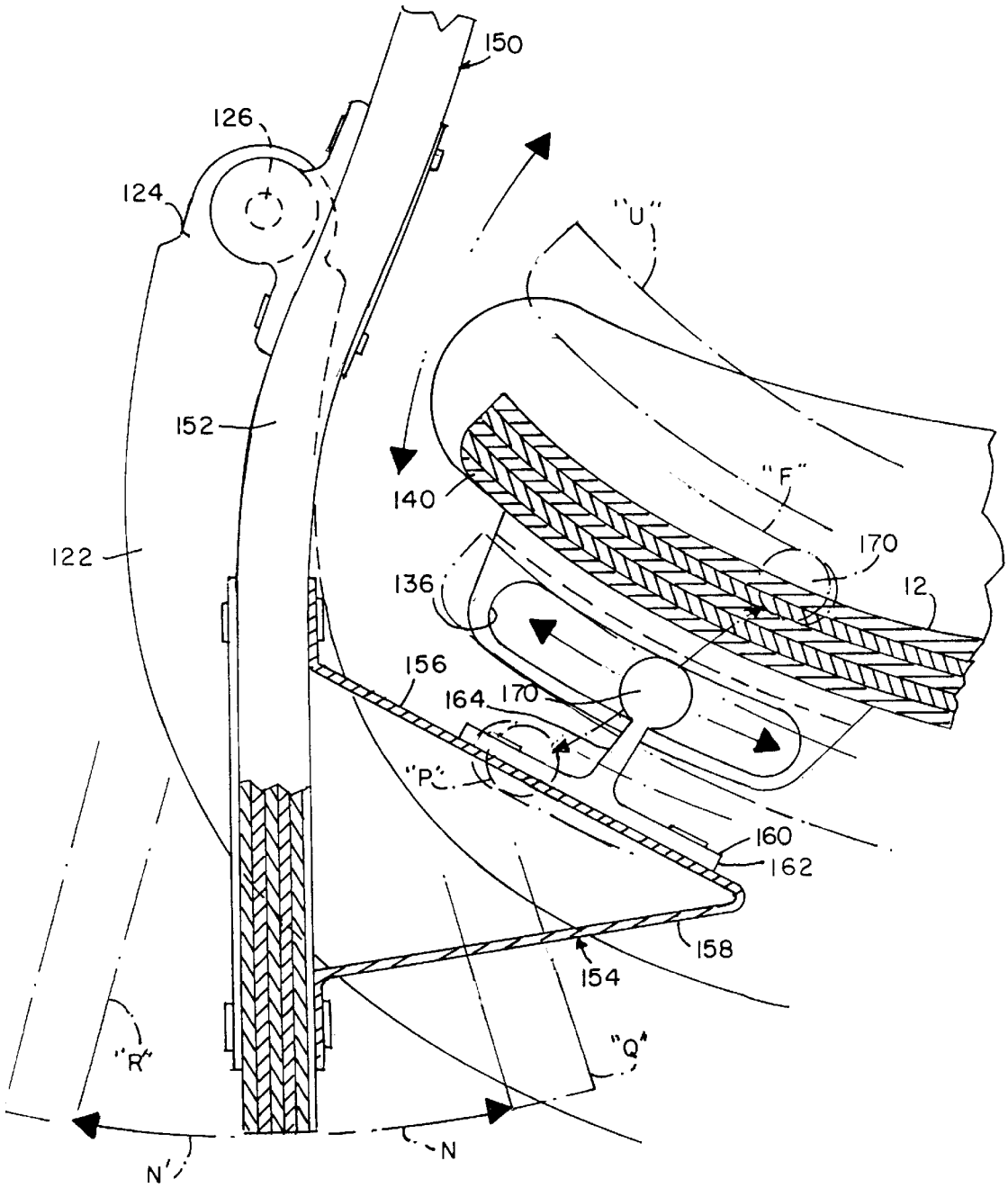
FIG. 4 is a side elevational view, partly in section of a portion of a further embodiment of the chair assembly.
Figure 5:
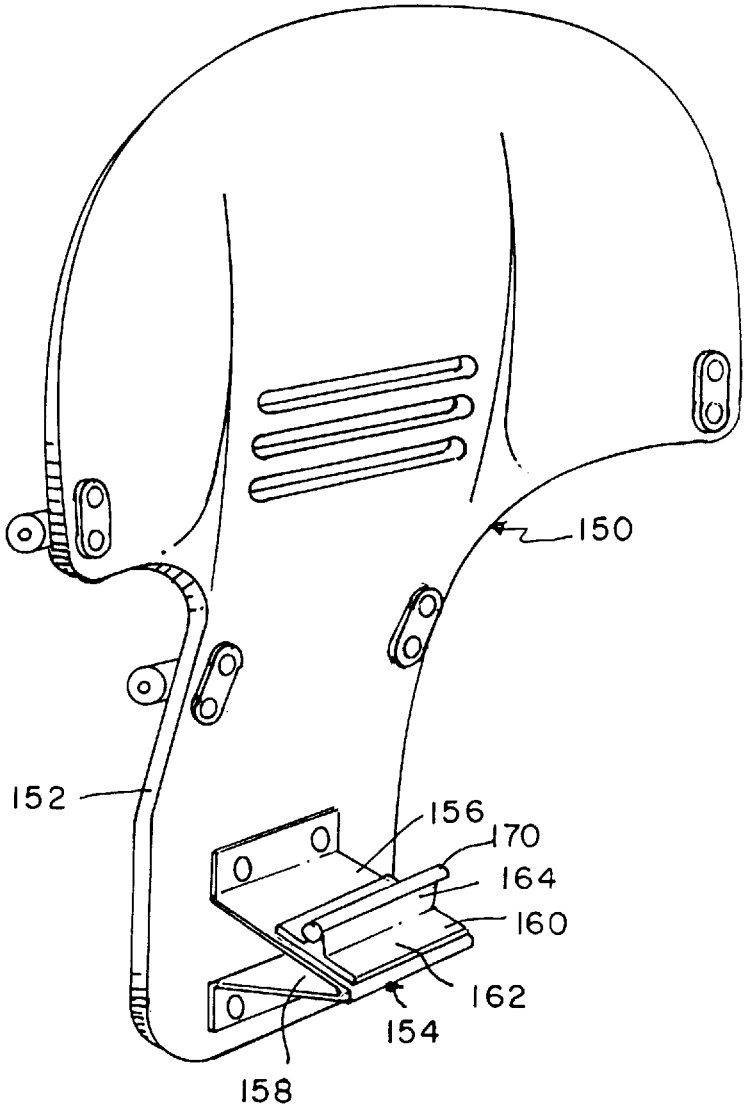
FIG. 5 is a perspective view of the back support panel of the further modification of the chair assembly, shown in FIG. 4.

The invention in a further embodiment, as shown in FIGS. 4 and 5, also includes a somewhat linear back support panel 150, which may be made of a molded polymer or molded multiple layers of wood product. The back support panel 150 in this embodiment differs from the aforementioned embodiment, in that its lowermost half portion 152 has only a slight molded curvature thereto, the lowermost portion 152 having a mounting bracket 154 thereon. The mounting bracket 154, which may be made of steel or heavy gauge polymer, is of somewhat "V" in transverse section, as may be seen in FIG. 4. The "V" frame mounting bracket 154 is comprised of an upper portion 156 and a lower portion 158. The upper portion 156 of the "V" shaped frame member 154 has a pin extrusion 160 thereon. The pin extrusion 160 may be attached to the upper portion 156 of the "V" shaped frame 154 by adhesive, bolts, or the like.

The pin extrusion 160, preferably made of a polymer or a metal such as steel, has a generally rectangular base 162 which is attached to the upper portion 156 of the "V" shaped frame mounting bracket 154. A support bar 164 extends generally perpendicularly upwardly from the planar base 162 of the pin extrusion 160, as shown in FIG. 4.

A rod-like pin member 170 is attached along the support bar 164 in longitudinal alignment therewith, as may be seen in FIG. 5. The pin member 170 and the support bar 164 are preferably of integral extrusion. The pin member 170 extends longitudinally beyond the ends of the support bar 164 as well as beyond the ends of the "V" shaped frame mounting bracket 154.

Each end of the pin member 170 is arranged to extend into the arcuate slot 136 at the rearward lowermost portion of the seat support panel 140, in a manner similar to the transversely extending horizontally disposed pins of the aforementioned embodiment shown in FIGS. 1 and 2.

The lower portion 152 of the back support panel 150 is permitted a forward and rearward pivoting, depending upon the posture of the user sitting in the seat panel 12 of the chair assembly and the location of the support pin member 170 within the arcuate slot 136 at the rearward lower portion 140 of the seat panel 12. This back support panel 150 is permitted to pivot about the upper distal ends 124 of the support strut members 122 to which it is pivotally attached. Such forward and rearward pivoting of the lower portion 152 of the back support panel 150, as shown by the arrows "N" and "N'" in FIG. 4, accommodates a corresponding rearward and forward pivoting of the upper portion (not shown) of the back support panel 150, of this embodiment. The support pin members 170 are caused to slide to the rear of the arcuate slot 136, as the seat support panel 140 pivots downwardly, as shown in phantom as "P", in FIG. 4, and the lowermost portion 152 of the back support panel 150 pivots rearwardly, as shown in phantom as "R" in FIG. 4, (and the upper portion of the back support panel 150 simultaneously pivots toward the forward side of the chair assembly, such forward pivoting not shown for clarity of the drawing). As the user of a chair assembly places his/her center of gravity towards a more forward position on the lower support panel 12 (as may be done in a "slouching" position), the rearward portion 140 of the support panel 12 is permitted to pivot upwardly, as shown in phantom as "U" in FIG. 4, thus effecting the support pin members 170 (only one shown here), to move in a direction towards the forward side of the arcuate slot 136, as shown in phantom "F" in FIG. 4, and thus the lower portion 152 of the back support panel 150 is pivoted forwardly about the pivot point 126 on its support struts 122 (only one being shown in FIG. 4), the upper portion of the back support panel pivoting correspondingly rearwardly (not shown for clarity of the drawing).

Thus it is shown in both the molded and generally linear embodiments of the back support panel 72 and 150, that a pivoting motion of the back support panel 72 and 150 is effected by the posture and positioning of a user on the lower seat support portion 12.

The registration and intermating of cooperative camming arrangements (pin members 134 and 170) and the cam slot members 136 of each embodiment, thus permit the articulation of each particular back support member 72 and 150 to reinforce the posture or lack thereof, of the user of the chair assembly.

The invention thus also includes a multi-position chair assembly for the full back and bottom support of a user through a range of sitting postures, comprising a movable lower bottom support panel secured to a hub and column by an adjustment control mechanism or other suspension system, and a back support panel pivotably secured to the hub by a frame connected to the hub and to the back support panel, the lower bottom support panel and the back panel having a linkage therebetween to permit tilting of the back support panel depending upon the tilting of the lower bottom support panel. The back support panel having a pair of cam members on a lower end thereof, and the lower bottom support panel having a pair of cam slots adjacent a lower back edge thereof, the cams and cam slots having a slidable relation to effect resultant pivotal movement in said back support panel when the bottom support panel is tilted about the adjustment control mechanism.

The frame comprises a pair of struts attached to the hub, the struts having distal upper ends which are pivotally connected to the back support panel, to permit such tilting thereof.

I claim:

1. A multi-position chair assembly permitting the support and comfort of a user thereof, in a plurality of sitting positions, comprising:

a lower chair support panel attached to an adjustable tilt support mechanism, which adjustable tilt support mechanism is carried by a vertically maintained hub; and a frame attached to said hub for supporting a chair back support panel;

said back support panel being pivotably attached to said frame to permit tilting of said back support panel relative to the center of gravity of a user of said chair assembly with respect to said adjustable tilt support mechanism under said lower support panel;

said lower support panel and said back support panel being connected by a single pair of slidable pivotable linkages which effects pivoting of said back support panel about a horizontal axis when said lower support panel is tilted about said adjustable tilt support mechanism;

said back support panel including a lowermost member having a carrier pin extending transversely from each corner thereof, and said lower support panel having a frame with a slot therein adjacent its rearward edge, each said carrier pin being in a cammed slidable linkage relationship with said slot to effect said single slidable pivotable linkage correction between said lower panel and said back support panel; and an arm rest disposed on each side of said chair assembly, said arm rest being pivotably connected at an upper end thereof, to said back support panel, and being pivotably connected at a lower end thereof, to said lower support panel, to permit limited articulation between said back and lower support panels and said arm rests.

2. The multi-position chair assembly as recited in claim 1, wherein said frame supporting said back support panel comprises a pair of arcuate struts having a lower end which are fixedly attached to a horizontal axle attached to said hub, each of said struts having an upper distalmost end with a pivot pin thereat, said pivot pin mated with a bearing location on said back support panel.

* * * * *